United States Patent [19]

Miettinen

[11] 4,058,310

[45] Nov. 15, 1977

[54] BOWLING BALL INCLUDING A MEANS FOR DISPLACING THE CENTER OF GRAVITY

[75] Inventor: Seppo I. Miettinen, Helsinki, Finland

[73] Assignee: The United States of America as represented by the Department of Commerce, Washington, D.C.

[21] Appl. No.: 626,548

[22] Filed: Oct. 28, 1975

[51] Int. Cl.[2] ..... A63B 43/04

[52] U.S. Cl. ..... 273/63 E; 273/DIG. 20; 273/171

[58] Field of Search ..... 273/63, 170, 171, 191 R, 273/128 A, 128 CS, 128 R, DIG. 20, 128

[56] References Cited

U.S. PATENT DOCUMENTS

| | | | |
|---|---|---|---|
| 746,576 | 12/1903 | Rice | 273/63 E |
| 2,432,450 | 12/1947 | Sears | 273/170 |
| 3,591,177 | 7/1971 | Skuse | 273/63 E |
| 3,876,212 | 4/1975 | Oppenheimer | 273/191 R |

*Primary Examiner*—George J. Marlo

[57] ABSTRACT

In the center of the bowling ball a three-way valve has been mounted and radiating from this, three tubes closed at one end, one of the tubes lying substantially in the plane containing the line of throw while the other two are laterally directed on either side of said plane. The system of tubes and valve contains a quantity of mercury substantially equivalent to the capacity of one tube, and the mercury may by means of the three-way valve be transferred from the central tube into one or the other side tube and thereby the center of gravity shifted to one side. The three-way valve is controllable by means of a stem, from the surface of the ball. In an alternative embodiment all three tubes lie in the plane containing the line of throw.

4 Claims, 3 Drawing Figures

BOWLING BALL INCLUDING A MEANS FOR DISPLACING THE CENTER OF GRAVITY

Figure 1:
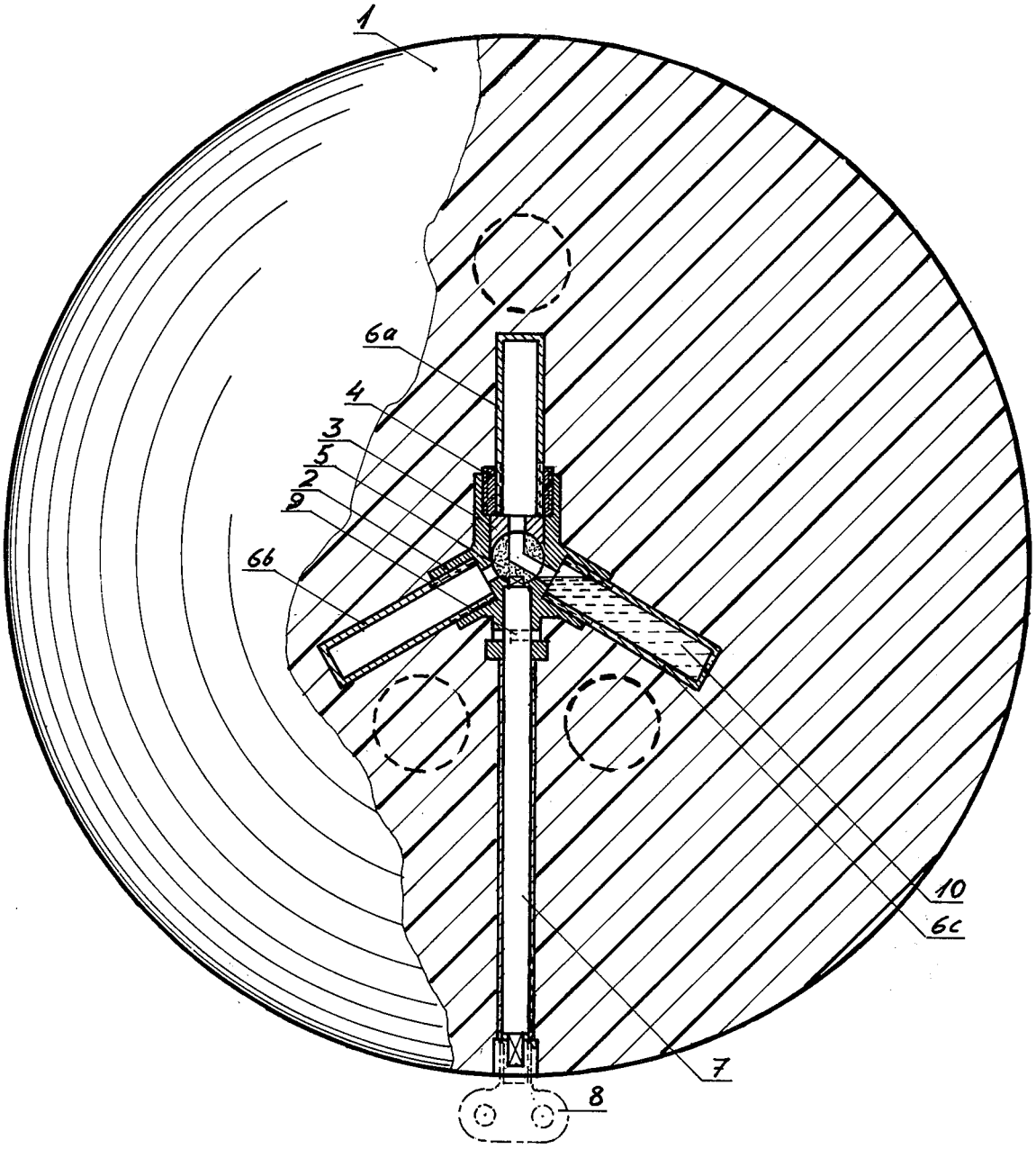

The present invention concerns a bowling ball including a means for displacing the ball's center of gravity, temporarily or for a prolonged period.

The significance of the invention will be understood if it is first observed that all bowlers when they throw the ball like to use the so-called hook because hereby they may expect the maximum number of strikes. The hook is accomplished either by imparting to the ball a swerve at the moment when it leaves the hand or by the expedient that the center of gravity of the ball lies on one side of the geometrical center of the ball, within the weight tolerances permitted by the International Bowling Federation (FIQ). The latter at all events aids the producing of a swerve. For instance, a weight on the left will cause the ball to swerve to the left, as right-handed bowlers wish it to do. However, the hook is not the most advantageous throw in all and any conditions. For instance, in certain situations where a spare is to be gained a straight throw is recommended. It would therefore be advisable to use a bowling ball the center of gravity of which can be laterally shifted. Such balls are in fact known in prior art, but they are mostly rather complex, and to effect the desired change is a laborious and slow undertaking. There are, for instance, bowling balls comprising one or several weights which are moved in various directions with the aid of screws and a screwdriver.

The object of the invention is to provide within the bowling ball a means by the aid of which the center of gravity is rapidly displaceable. This is made possible according to the invention by utilizing a comparatively heavy fluid, such as mercury. In the center of the bowling ball a three-way valve or equivalent has been mounted, from which radiate three tubes having a given length and closed at the other end, one of them (the so-called central tube) located substantially in the vertical plane containing the line of throw and the other two being directed e.g. to the sides on either side of said vertical plane, and the said system of tubes and valve containing a quantity of mercury substantially equivalent to the capacity of one of the tubes. Through the three-way valve, which is controllable from the surface of the ball, the mercury may be caused under gravity effect to pass from the central tube into either of the side tubes, or vice versa. This affords three different possibilities for displacing the center of gravity of the ball. For instance, if the hook tends to be excessive, the weight may be shifted into the other extreme position.

The invention is described in the following with reference to an embodiment presented in the attached drawing.

Figure 2:
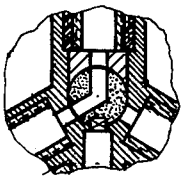
Figure 3:
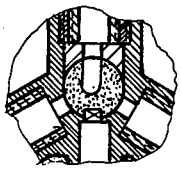

In the drawing,

FIG. 1 presents a bowling ball according to the invention, partly sectioned through its center to reveal the three-way valve, which is in the position in which it connects the central tube with the side on the right in the figure, FIG. 2 is a partial view of the same three-way valve when it provides a communication between the central tube and the side tube on the left in the figure, and FIG. 3 is similarly a partial view, showing the three-way valve in its closed position.

In the approximate center of the bowling ball 1 a three-way valve has been fitted, consisting in this instance of a so-called three-way spherical valve comprising in a housing 2, a valve sphere 5 mounted with the aid of a sealing ring 3 and a fixing sleeve 4, and which sphere is pierced by a passage substantially shaped like a letter L and made to conform to the positions of the tubes. Three tubes 6 with closed ends have been radially affixed to the valve housing 2 with threads so that the central tube **6*a* lies substantially in the vertical plane containing the line of throw (upwardly in the plane of the drawing), and the side tubes 6*b* and 6*c* are disposed on either side of said plane. In the case depicted in the figure the side tubes 6*b* and 6*c* are obliquely downwardly directed, but they may naturally also be directed to the sides at right angles. The lower part of the valve sphere 5 carries, for instance, a square recess to accommodate the upper end of the valve stem 7. The valve stem 7 extends from the housing 2 to close within the outer surface of the ball 1 and carries on its outer end likewise a square stem head, for instance, whereby it can be turned with a suitable key 8. The rotation of the stem 7 is limited by a small peg 9 set in it and moving in a mating groove in the housing 2, the range of motion being 180° in the case depicted. The system of tubes and valve just described contains a quantity of mercury 10 equivalent to the capacity of one tube 6**.

The means according to the invention operates as follows. When the mercury 10 resides in the central tube **6*a* and it is desired to move it into the side tube 6*c*, the key 8 is used to turn the stem 7 and the sphere 5 into the position of FIG. 1, as a consequence whereof, when the ball 1 is in the correct position (e.g. that shown in FIG. 1), the mercury 10 flows into the tube 6*c*. This situation is illustrated by FIG. 1. The valve sphere is then turned through 90°, that is into the position shown in FIG. 3, whereupon the ball is ready to be used. A similar procedure is applied when it is desired to move the mercury 10 back into the central tube 6*a* or into the other side tube 6*b*. In the embodiment shown here the mercury 10** cannot be directly transferred from one side tube into the other: it must be conveyed by way of the central tube.

The invention is in no way confined to the embodiment example presented, and other designs are possible within the scope of the claims following below. It is also possible to give the means of the invention another orientation, that is to arrange all tubes to lie in the plane containing the line of throw; the means is then employed to adjust the so-called finger balance of the bowling ball. A combination of the two adjustments is also conceivable.

This is claimed:

1. In a bowling ball, a means for displacing the center of gravity, comprising

- within the ball, substantially at its geometrical center, a three-way valve, wherefrom radiate three tubes with one closed end, at least one of these tubes lying substantially in the vertical plane passing through the geometrical centre of the ball and through the centermost of its three finger holes,
- enclosed in said system of tubes and valve, a quantity of a heavy fluid substantially equivalent to the capacity of one tube and which can be selectively made to enter any one of said three tubes with the aid of the three-way valve and of gravity action, and a mechanical member shaped as a stem, with the aid of which the position of the three-way valve is controllable from the outer surface of the bowling ball.

2. A bowling ball as defined in claim 1, wherein the three-way valve consists of a three-way spherical valve, comprising

- a turnable sphere mounted in a valve housing with the aid of a sealing ring and a fixing sleeve and pierced by a substantially L-shaped passage conforming to the disposition of said tubes, and which sphere has in its lower part a square recess or equivalent for engagement with a means by which the sphere is turned, and
- a stem extending from the valve housing to the outer surface of the bowling ball and which is turnable and on its upper end carries a stem end fitting into the square recess or equivalent, and at its lower end a similar stem end, a detachable key means fitting and usable to turn the last-mentioned stem end.

3. A bowling ball as defined in claim 1, wherein one of said tubes lies as specified in claim 1 and the other two tubes lie on either side of said plane and point in different directions ranging from that at right angles to said plane to a downwardly oblique direction.

4. A bowling ball as defined in claim 1, wherein all three tubes lie in one plane.

* * * * *

UNITED STATES PATENT OFFICE

CERTIFICATE OF CORRECTION

Patent No. 4,058,310 Dated November 15, 1977

Inventor(s) Seppo I. Miettinen

It is certified that error appears in the above-identified patent and that said Letters Patent are hereby corrected as shown below:

On the cover sheet, the illustrative figure should appear as shown on the attached sheet.

Signed and Sealed this

*Twenty-first* Day of *February 1978*

[SEAL]

*Attest:*

RUTH C. MASON
*Attesting Officer*

LUTRELLE F. PARKER
*Acting Commissioner of Patents and Trademarks*

UNITED STATES PATENT OFFICE
CERTIFICATE OF CORRECTION

Patent No. 4,058,310 Dated November 15, 1977

Inventor(s) Seppo I. Miettinen

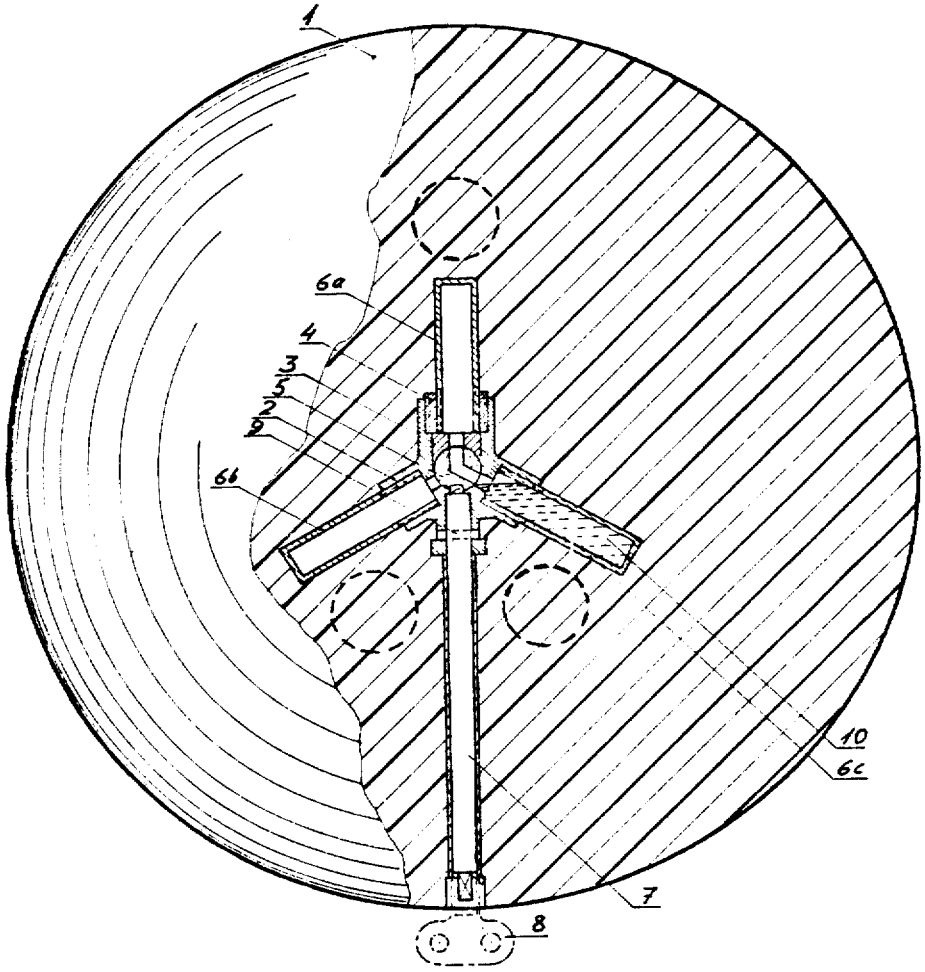

It is certified that error appears in the above-identified patent and that said Letters Patent are hereby corrected as shown below: